US008857026B2

(12) United States Patent
Yang

(10) Patent No.: US 8,857,026 B2
(45) Date of Patent: Oct. 14, 2014

(54) INTEGRAL REMANUFACTURING PROCESS OF DISCARDED OIL PIPE

(76) Inventor: Yongli Yang, Changchun (CN)

( * ) Notice: Subject to any disclaimer, the term of this patent is extended or adjusted under 35 U.S.C. 154(b) by 180 days.

(21) Appl. No.: 13/464,989

(22) Filed: May 6, 2012

(65) Prior Publication Data

US 2013/0291986 A1 Nov. 7, 2013

(51) Int. Cl.
*B23P 6/00* (2006.01)
*F16L 55/18* (2006.01)

(52) U.S. Cl.
USPC ..... 29/402.18; 29/402.09; 138/97

(58) Field of Classification Search
USPC ..... 29/402.09, 402.18, 402.01; 138/97
See application file for complete search history.

(56) References Cited

U.S. PATENT DOCUMENTS 3,278,324 A * 10/1966 Nelson ..... 427/183
3,467,410 A * 9/1969 Chandler ..... 285/55
3,551,188 A * 12/1970 Lindquist ..... 427/234
4,150,182 A * 4/1979 Pignocco et al. ..... 428/34.6
4,363,832 A * 12/1982 Odawara ..... 427/183
5,302,340 A * 4/1994 Takeda ..... 419/45
5,864,232 A * 1/1999 Laursen ..... 324/220
8,356,518 B2 * 1/2013 Alleyne et al. ..... 73/623
2004/0003856 A1 * 1/2004 Quigley et al. ..... 138/98
2004/0020071 A1 * 2/2004 Johnen et al. ..... 34/226
2006/0137754 A1 * 6/2006 Quigley et al. ..... 138/98
2008/0106260 A1 * 5/2008 Rogers ..... 324/240
2009/0158850 A1 * 6/2009 Alleyne et al. ..... 73/623
2010/0243092 A1 * 9/2010 Gillanders et al. ..... 138/97
2013/0074970 A1 * 3/2013 Gillanders et al. ..... 138/97
2013/0294954 A1 * 11/2013 Yang ..... 417/437

* cited by examiner

*Primary Examiner* — Essama Omgba

(57) ABSTRACT

An integral remanufacturing process of discarded oil pipe, including steps of: preprocessing, including picking out the discarded pipe with wall of 2.8 mm thickness or above, detaching the coupling, checking the Magnetic flux leakage, cutting the thread, eliminating oil and stain, straightening, blasting, and sorting according to different length; lining with ceramic, wherein in the centrifugal machine spinning with high speed, the melted iron liquid via selfpropagating reaction is filled into the ditches and corrosion pits of the inner wall to combine with the inner wall of the oil pipe, and is integrated with the transition iron layer under the ceramic layer, and machining thread including machining thread at the end of the pipe by using numerically controlled lathe and precision comb knife, applying thread compound, and attaching the coupling.

3 Claims, No Drawings

INTEGRAL REMANUFACTURING PROCESS OF DISCARDED OIL PIPE

BACKGROUND OF THE PRESENT INVENTION

1. Field of Invention

The present relates to remanufacturing industry of mechanical and electrical products and more particularly to an integral remanufacturing process of discarded oil pipe via Selfpropagating Hightemperature Synthesis (SHS) technology.

2. Description of Related Arts

The oil pipe is a steel cylindrical pipe that drops into the oil well casing in the oil and gas field, and is a passage to transport oil from underground to ground.

Meanwhile, the oil pipe is the second-mostly used tubular product among oil country tubular goods, and is second only to the oil casing. The quantity of oil pipes of each oil field can be up to 100 thousand-tons.

Due to corrosion and attrition, the life span of oil pipes and pipe lines are greatly reduced. Especially, with the development of the well drilling technique, the sucker rod and coupling directly contact with the wall of the pipe in the inclined well and horizontal well, which results in the life span of the ordinary pipe line is less than two years.

Besides, the corrosion medium of the liquid yield in the oil field mainly includes CO2, H2S, saline water and sulfate reducing bacteria. These corrosion medium causes through holes in the oil pipe, casing and transportation pipe, which results in the useless of the oil well, and severely impacts the oil production.

Currently, many oil wells in China have been stepped into a late-mid phase of the exploit, and the number of the oil well is up to 50 thousands.

Accidents caused by the corrosion, attrition, and crack or fraction are very frequent. Due to the strict rules of discarding oil pipes, a great amount of the oil pipes that can be remanufactured have been discarded. In this case, a remanufacturing technology of discarded oil pipe can not only reduce the amount of discarded oil pipe, but also greatly reduce the cost of the oil field.

SUMMARY OF THE PRESENT INVENTION

A technical problem that the present invention is about to solve is to provide an integral remanufacturing process of discarded oil pipe via Selfpropagating Hightemperature Synthesis (SHS) technology.

In order to solve the above problem, the present invention provides an integral remanufacturing process of discarded oil pipe, which includes the following steps:

1. Preprocessing: Picking out the discarded pipe with wall of 2.8 mm thickness or above, detaching the coupling, checking the Magnetic flux leakage, cutting the thread, eliminating oil and stain, straightening, blasting, and sorting according to different length;

2. Lining with ceramic: in the centrifugal machine spinning with high speed, the melted iron liquid via selfpropagating reaction is filled into the ditches and corrosion pits of the inner wall to combine with the inner wall of the oil pipe, and is integrated with the transition iron layer under the ceramic layer;

3. Machining thread: machining thread at the end of the pipe by using numerically controlled lathe and precision comb knife, applying thread compound, and attaching the coupling.

The condition of eliminating oil and stain: in a constant temperature of 400° C.-500° C. by using high-temperature pyrolysis furnace.

The advantage and beneficial effect of the present invention comparing to the prior art is illustrated as follows.

1. A new rule of discarding oil pipe in the oil field can be reestablished, so as to greatly reduce the amount of the discarded oil pipes, and increase the amount of the oil pipes that can be remanufactured.

2. The remanufactured oil pipe has a life span 5 times longer than the original oil pipe, which greatly reduces the investment of the oil field.

These and other objectives, features, and advantages of the present invention will become apparent from the following detailed description, the accompanying drawings, and the appended claims.

DETAILED DESCRIPTION OF THE PREFERRED EMBODIMENT

Embodiment 1

1. Preprocessing

Preprocessing is an important step of the whole remanufacturing process.

It includes seven steps: detaching the coupling, checking the Magnetic flux leakage, cutting the thread, eliminating oil and stain, straightening, blasting, and sorting according to different length.

(1) Detaching the Coupling

Detach the old coupling by using hydraulic screwing machine, which is fast and does no harm to the oil pipe.

(2) Measuring the Thickness of the Wall

Check the discarded oil pipe, according to different corrosion and attrition degree in order to reject the discarded oil pipe with thin wall that cannot bear the stress under the well, and choose the oil pipe with a thickness of 2.8 or above.

The stress of the oil well is usually less than 10 Mpa in normal condition; the stress of water injection in the main line under atmospheric pressure is usually 18 Mpa (the stress of water injection under high-pressure is 31-35 Mpa, the stress of water injection under ultra-high pressure is 50 Mpa).

Magnetic flux leakage test is the most widely used magnetic testing method, due to its good testing ability and high automatic degree, and is especially widely used for testing steel tube in the oil field.

Magnetic flux leakage test can pick out the discarded oil pipe that can be remanufactured, and discard the old oil pipe that cannot be repaired.

(3) Cutting Thread

Cut the old thread by using thread cutting machine.

(4) High-Temperature Pyrolysis

Eliminating oil and stain and blasting of the inner wall of discarded oil pipe is the key of the preprocessing step, because only the clean inner wall can secure the ceramic layer thereon.

The traditional lye cleaning method will produce a great amount of waste water, and the stain cannot be cleaned completely; eliminating oil and stain by using high-temperature pyrolysis furnace only produces a small amount of waste gas, which is a very good method.

Due to the complex composition of the petroleum, (its flash point is −20-100° C.; spontaneous ignition temperature is 380-530° C.), different pyrolysis temperature of different composition, so that the highest temperature of the furnace is set with 500° C.

When the temperature is increasing, the oil residue in the oil pipe is flowing out of the furnace, so that it won't be burned to produce CO2. Set the time for 4 hours, so that the oil residue and stain can be completely pyrolysed.

The temperature in the furnace should be strictly controlled, so as to avoid visible flame in the furnace.

(5) Blasting

Blast the discarded oil pipe after the oil and stain is removed, so as to remove the loosened stain and oxide.

Two hose blasting machine is used for blasting the inner wall of the discarded oil piped, based on the national standard GB8923-88, "Rust grades and preparation grades of steel surfaces before application of paints and related products", cleaning grade Sa2.5—No visual oil, stain, oxide coating, rust, and paint coating; any residue mark is only spot or strip shaped light color stain.

2. Lining with Ceramic

The ceramic lining is the core step of the remanufacturing process; the key equipment is the self-developed centrifugal machine (ZL 200710055681).

The advantage of the centrifugal machine is that it is super long, up to 9.4 m, has high spinning speed, up to 2300 rpm, and can resist heat (it can operate under the 900° C. ceramic lining of the oil pipe), and most importantly, it has good dynamic balance, which is up to G6.3 when cooperating with a special secure casing; it also has large centrifugal force (the centrifugal force on the inner wall of ϕ73*5.5 oil pipe is up to 180-200 g); furthermore, it is intelligent with electronic speed measurement and vibration measurement systems.

When ceramic is being lined, in the centrifugal machine spinning with high speed, the melted iron liquid through selfpropagating reaction is filled into the ditches and corrosion pits of the inner wall to combine with the inner wall of the oil pipe, and is integrated with the transition iron layer under the ceramic layer; the ceramic layer is closely integrated with the iron layer under the crushing stress so as to form a secure protective layer for the discarded oil pipe.

The high speed, super long centrifugal machine is the core equipment of this process. The up to 200 g centrifugal force can separate the iron layer and the ceramic layer, reduce the air hole in the ceramic layer, increase attrition resistant ability of the ceramic layer by increasing its density and hardness; The appropriate addition agent prolongs the melting time of Al2O3, reduces the microcrack and air hole, and improves the corrosion resistant ability of the ceramic layer.

3. Machining Thread

Machine thread at the end of the pipe by using numerically controlled lathe and precision comb knife, according to the API Spec 5CT.

The thread machining of the oil pipe should meet the entire parameter standard in order to ensure the connectivity and tightness of the tread and to make the oil pipe function.

And then, apply thread compound and attach the coupling according to the API Spec 5CT.

4. Testing

Firstly, check the quality of the ceramic layer of remanufactured ceramic-lined composite oil pipe by using endoscopy, and reject the unqualified products according to the enterprise standard of ceramic-lined composite oil pipe; Then inspect the thread according to the standard of API Spec 5CT, and conduct drift test and hydrostatic pressure test to ensure the function and safety of the remanufactured ceramic-lined oil pipe.

5. Packing

Based on the API Spec 5CT, measure the length of the remanufactured ceramic-lined oil pipe, weigh it, spray label on it, spray paint on it, pack it with steel belt, and store it for delivering.

Embodiment 2

Pick out a discarded oil pipe with a thickness 3.75 mm for being remanufactured. Other steps are same to the embodiment 1.

Embodiment 3

Pick out a discarded oil pipe with a thickness 4 mm for being remanufactured. Other steps are same to the embodiment 1.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An integral remanufacturing process of discarded oil pipe, including steps of:

preprocessing, including picking out the discarded pipe with wall of 2.8 mm thickness or above, detaching a coupling, checking magnetic flux leakage, cutting a thread, eliminating oil and stain with a constant temperature of 400° C.~500° C. in a high-temperature pyrolysis furnace, straightening, blasting, and sorting according to different lengths;

lining with ceramic, wherein in a centrifugal machine spinning with high speed, melted iron liquid via selfpropagating reaction is filled into ditches and corrosion pits of an inner wall to combine with the inner wall of the oil pipe, and is integrated with a transition iron layer under the ceramic layer, an addition agent is added for prolonging a melting time for reducing microcracks as well as air holes, in such a manner that a corrosion resistant ability of the ceramic layer is improved; and machining thread including machining thread at the end of the pipe by using numerically controlled lathe and precision comb knife, applying thread compound, and attaching the coupling.

2. The integral remanufacturing process, as recited in claim 1, wherein the centrifugal machine has a length up to 9.4 m, so as to process a long pipe; the centrifugal machine has a high spinning speed up to 2300 rpm, and is able to resist a heat up to 900° C.

3. The integral remanufacturing process, as recited in claim 1, wherein a centrifugal force on an inner wall of an oil pipe with ϕ73*5.5 is up to 180~200 g.

* * * * *